US006147576A

United States Patent [19]

Arevalo

[11] Patent Number: 6,147,576

[45] Date of Patent: Nov. 14, 2000

[54] FILTER DESIGNS UTILIZING PARASITIC AND FIELD EFFECTS

[75] Inventor: Augusto Arevalo, Miami, Fla.

[73] Assignee: Ameramp LLC, Carlsbad, Calif.

[21] Appl. No.: 09/058,695

[22] Filed: Apr. 10, 1998

[51] Int. Cl.[7] ..... H01P 1/203

[52] U.S. Cl. ..... 333/204; 333/176

[58] Field of Search ..... 333/176, 204, 333/205

[56] References Cited

U.S. PATENT DOCUMENTS

| | | | |
|---|---|---|---|
| 3,596,204 | 7/1971 | Vane | 333/235 X |
| 3,739,245 | 6/1973 | Fuchshuber et al. | 361/273 |
| 5,173,671 | 12/1992 | Wendler et al. | 333/204 X |
| 5,430,895 | 7/1995 | Huusko | 333/204 X |
| 5,485,131 | 1/1996 | Fajen et al. | 333/204 X |
| 5,574,413 | 11/1996 | Ruelke | 333/174 |
| 5,801,602 | 9/1998 | Fawal et al. | 333/184 X |
| 5,812,037 | 9/1998 | Block | 333/204 |

FOREIGN PATENT DOCUMENTS

| | | | |
|---|---|---|---|
| 1298-817 | 3/1987 | U.S.S.R. | 333/204 |

*Primary Examiner*—Justin P. Bettendorf
*Attorney, Agent, or Firm*—Gray Cary Ware Freidenrich

[57] ABSTRACT

A method for designing a filtering device essentially comprising the steps of determining a desired response of the filtering device at a selected frequency; and selecting a circuit element that exhibits a parasitic effect at the selected frequency, wherein the parasitic effect results in the circuit element having the desired response at the selected frequency. A second method for designing a filtering device, similar to the first, but utilizes a field effect at the selected frequency, instead of a parasitic effect.

A frequency converter comprising a notch filter which filters a first frequency and does not filter a second frequency. The notch filter comprises a lumped parameter element and a transmission line, wherein the transmission line is coupled to the lumped parameter element.

10 Claims, 2 Drawing Sheets

FILTER DESIGNS UTILIZING PARASITIC AND FIELD EFFECTS

CROSS REFERENCE TO RELATED APPLICATIONS

Not applicable

BACKGROUND OF THE INVENTION

1. Field of the Invention

The invention disclosed broadly relates to electronic filtering devices, and more particularly relates to the design of filters using microstrip elements and utilizing parasitic and field effects.

2. Description of the Related Art

FIG. 1 shows a block diagram of prior art for a downconverter, which is a frequency converter that shifts an input frequency to a lower frequency. The control circuit 102 controls the signal generator 104, which may be a voltage controlled oscillator ("VCO"). The signal generator 104 produces a local oscillator signal (the "LO signal") that contains a specific and desired frequency (the "LO frequency"), as well as a series of harmonics at multiples of the LO frequency. An attenuator 106 is used to protect the signal generator 104 by dampening any signals that are reflected and travel back into it. In the circuit of FIG. 1, filter 108 filters the second harmonic, which has a frequency of twice the LO frequency, from the signal generator 104, and filter 112 filters the second harmonic generated by the non-linearities of the LO amplifier 110. Filters 108 and 112 are generically shown because they can be implemented in a variety of means, including low pass, bandpass, or notch. The capacitors 109 and 111 are used for direct current ("DC") decoupling from the bias currents of the LO amplifier 110.

The second harmonic is then further filtered by notch filter 114 before the LO signal is mixed with the input signal, which is often in either the radio frequency ("RF") or microwave range. Because this example is a downconverter, the frequency of interest at the output of the mixer 116 is the intermediate frequency ("IF"), and the filter 118 has therefore been chosen as a lowpass filter that isolates the IF range.

Notch filters 120 and 124 further reduce, both before and after the IF amplifier 122, any LO frequency that may still be present on the signal, and the capacitors 121 and 123 are again used for DC decoupling from the bias currents of the IF amplifier 122. The surface-acoustic wave ("SAW") filter 126 is a narrow bandpass filter that is used to further isolate the IF ranged. SAWs are acoustically coupled devices, however, and therefore they typically do not reject frequencies far removed from their passband. Because the LO frequency is far removed from the IF, the SAW filter 126 does not adequately filter it and the notch filters 120, 124 are necessary to remove the LO frequency.

Because of the number of filters required to accomplish the downconversion, these circuits require a large board. Additionally, filters must typically be tuned after manufacture to ensure that they filter the appropriate frequencies, and this slows the manufacturing process and makes it harder to achieve identical performance from each circuit. Accordingly, there is a need for filtering devices and methods of designing filters which overcome these problems.

SUMMARY OF THE INVENTION

Briefly, in accordance with one aspect of the invention, there is provided a first method for designing a filtering device comprising the steps of selecting a frequency; determining a desired response of the filtering device at the selected frequency; and selecting a circuit element, for use in the filtering device, that exhibits a parasitic effect at the selected frequency, wherein the parasitic effect results in the circuit element having a response that deviates from the accepted ideal response of similar circuit elements at the selected frequency, and wherein the deviating response comprises the desired response.

Briefly, in accordance with another aspect of the invention, there is provided a second method for designing a filtering device comprising the steps of selecting a frequency; determining a desired response of the filtering device at the selected frequency; selecting a circuit element, for use in the filtering device, that exhibits a field effect at the selected frequency, wherein the field effect produces the desired response at the selected frequency; and orienting the circuit element in the filtering device such that the field effect is utilized to achieve the desired response at the selected frequency.

Both methods can be implemented with a circuit comprising a circuit element that exhibits either a parasitic effect or a field effect (depending on the method) at a selected frequency. The circuit is designed, at least in part, to utilize the parasitic effect or field effect. Both methods can also be implemented with a computer readable medium such as a diskette, CD ROM, or transmitted waveform, comprising instructions for the methods.

Briefly, in accordance with another aspect of the invention, there is provided a frequency converter comprising a notch filter which filters a first frequency and does not filter a second frequency. The notch filter comprises a lumped parameter element and a transmission line, wherein the transmission line is coupled to the lumped parameter element.

DETAILED DESCRIPTION OF AN EMBODIMENT

The invention utilizes parasitic effects and field effects to achieve design objectives, instead of designing to avoid these effects. The invention also employs microstrip, as well as other circuit elements. The combination of these features eliminates altogether the need to design or use standard configuration filters, and allows the design of filtering devices, and circuits which contain filters, that have fewer and less expensive components and that are simpler to manufacture.

Figure 1:
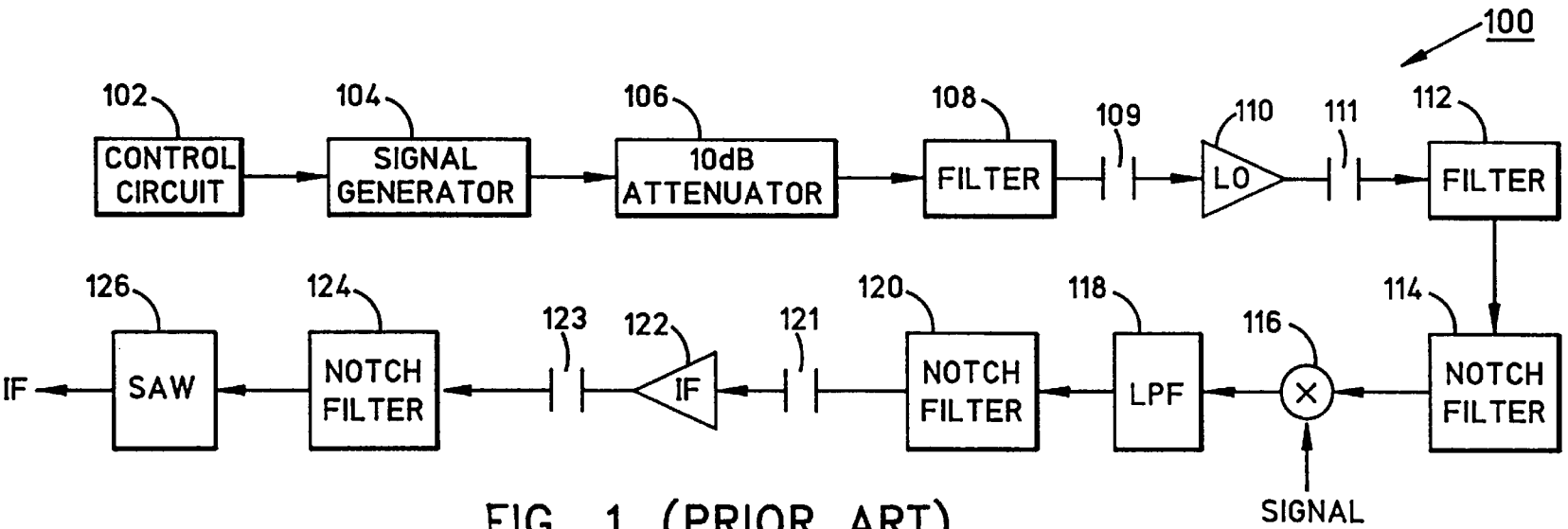
FIG. 1 (PRIOR ART)
FIG. 1 is a block diagram of a typical downconverter according to the prior art.
Figure 2:
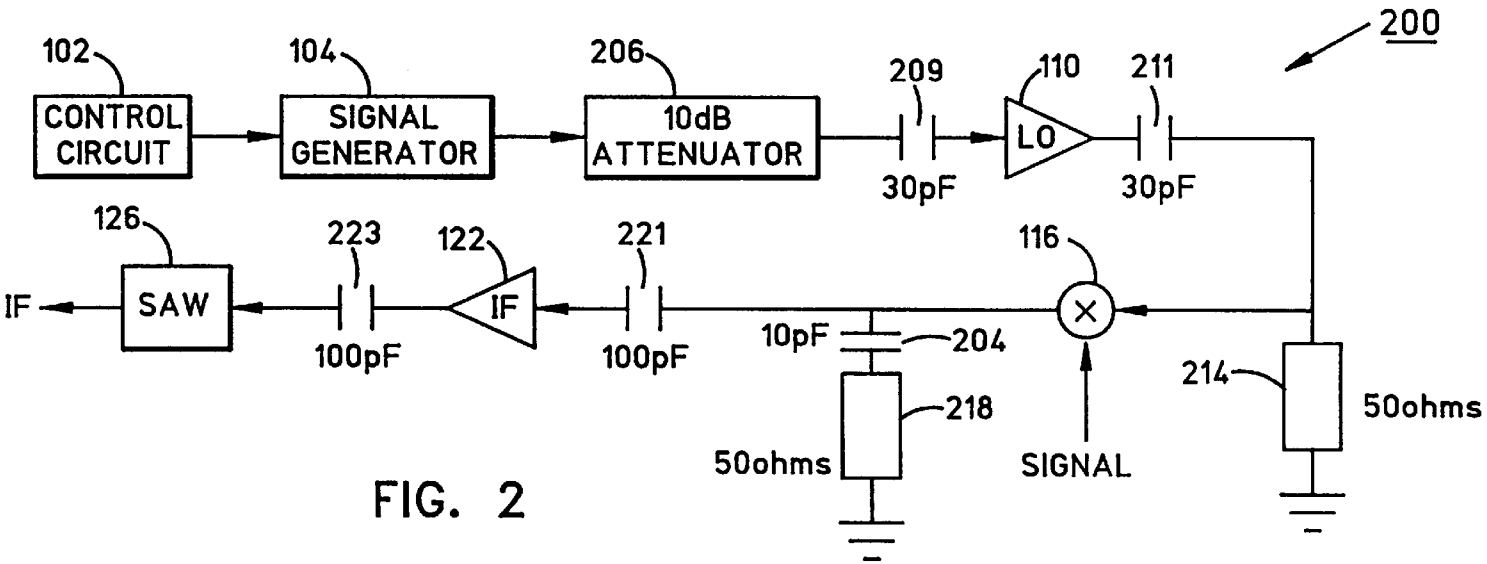
FIG. 2 is a block diagram of a downconverter similar to that in FIG. 1, but according to the present invention and utilizing filtering devices according to the present invention.

Referring to FIG. 2, there is shown a downconverter 200 similar to that in FIG. 1, but designed according to the present invention and utilizing filtering devices according to the present invention. This circuit 200 contains filtering devices that utilize both parasitic effects and field effects to filter specific frequencies.

Parasitic effects refer broadly to those effects, exhibited by virtually all circuit elements, that cause a response that is not ideal and which are therefore not normally utilized by the designer. It is not merely the typical circuit elements, such as capacitors, inductors, resistors, etc., that exhibit parasitic effects, but also the often overlooked circuit elements such as connecting wires and leads. Parasitic effects are often caused by the structure or composition of the circuit element, but may arise for other reasons as well. Concepts such as resonating frequencies (series or parallel), skin effect, self-inductance, shunt capacitance, leakage current, series resistance of a capacitor, stray inductance and capacitance, interelectrode capacitance, interwinding capacitance, lead capacitance, etc. are all examples of parasitic effects that give rise to non-ideal responses at particular frequencies. One general commonality is that parasitic effects tend to be exhibited at frequencies higher than those for which the device is specified by the manufacturer. In some cases however, parasitic effects, for example resonating frequencies, are often specified in manufacturer's data sheets, but this is typically done to alert the designer to them so that they can be avoided. Indeed, the prior art teaches away from utilizing parasitic effects in a circuit, and teaches the designer to be aware of parasitic effects in order to avoid their impact (see e.g., *RF Circuit Design*, Bowick, pp.9–30).

Field effects are another aspect of circuit design which designers typically try to avoid. Field effects, or electromagnetic field effects, arise at all frequencies because an electromagnetic wave traveling on a transmission line has an effect on any neighboring transmission lines. However, at low frequencies these field effects can typically be ignored by designers because the wavelengths are large in comparison to the circuit dimensions. At higher frequencies, wavelengths drop to lengths that are comparable with circuit dimensions and the field effects can no longer be ignored. Typically designers take steps to minimize the impact of field effects, such as using shielding, but they do not take advantage of the effects to augment the circuit's performance or efficiency.

Despite the teaching of the prior art to avoid parasitic effects, capacitors 209, 211, 221, and 223 are all intentionally chosen because their parasitic effects result in the filtering of specific frequencies. Capacitors 209 and 211 filter the second harmonic coming from the signal generator 104, and capacitors 221 and 223 filter the LO frequency itself which is 1960 MHZ in this embodiment. Selecting the capacitors 209, 211, 221, and 223 in this manner renders the filters 108, 112, 120, and 124 unnecessary, and provides a considerable savings in board space, component cost, and manufacturing time.

The best method of determining the frequency characteristics of a circuit element is to do a frequency sweep of it. However, data sheets can be used to aid the designer in determining how a circuit element's frequency characteristic is affected by parasitic effects. In particular, resonating frequencies are often included in the specification sheets from a manufacturer. The frequency response is dependent upon a number of factors, including the manufacturer, brand, material, size, and value. Fortunately for the designer, all parts with the same part number (and therefore the same manufacturer, brand, material, size, value, etc.) will typically have very similar frequency responses.

Alternate embodiments may utilize different circuit elements, such as inductors, to either filter specific frequencies or pass specific frequencies while filtering all others. For example, while inductors have a characteristic response that filters higher frequencies, each inductor has a resonant frequency in this filtered band which the inductor will pass. This parasitic effect could be used in a variety of filtering applications, including an upconverter where the mixer output needs to be filtered so that the RF is all that passes. In such an application, an inductor could be selected that has a resonating frequency at the RF and would therefore filter all high frequency components except the RF.

The notch filter 114 of FIG. 1 is replaced with a microstrip notch filter 214 in FIG. 2. A well-known advantage of microstrip is that its electromagnetic response is determined by its dimensions. The length of the notch filter must be equal to ½ of the wavelength of the frequency that needs to be filtered. In this case, that is ½ of the wavelength of the second harmonic, which is ¼ of the wavelength of the LO frequency. The microstrip 214 has a width that gives it an impedance of 50 ohms, and is short-circuited to ground at its opposite end, as indicated in FIG. 2. This results in a "wall" which reflects the signal and allows the cancellation of the second harmonic. Alternate implementations of a wall exist, two of the most common being to use an open-circuit instead of a short-circuit, or to use a ¼-wave low-impedance stub. The use of microstrip to implement the filters allows the circuit to be manufactured more quickly and reliably because there are fewer components. Additionally, because microstrips and stripline structures are photographically repeatable printed circuit board artwork, and high quality capacitors have vent repeatable response characteristics, none of them need to be tuned. Other types of transmission lines besides microstrip may also be employed.

The filter 118 of FIG. 1 is replaced with a microstrip notch filter 218 and a capacitor 204 in FIG. 2. The capacitor 204 is essential because without it the IF signal would be short-circuited to ground because the length of the microstrip 218 is relatively short compared to the IF's wavelength. Coupling the capacitor 204 and the microstrip 218 together and then coupling this combination to the output of the mixer 116 represents one of the novel aspects of the present invention, and can be applied in any downconversion application.

The capacitor 204 has a very low capacitance, and therefore a high impedance (high reactance) at the IF, which is 70 MHZ in this embodiment, and the IF therefore does not pass through to the microstrip 218 (that is, the IF is filtered; filtering is generally achieved, without limitation, by either absorbing, reflecting, or canceling the energy). Capacitor 204, however, has a low impedance (low reactance) of close to zero ohms at the LO frequency and the LO frequency therefore passes through unfiltered to the microstrip 218. The designer can utilize the equation for capacitive reactance ($X_c$=½ πfC) to help predict the proper capacitor values, but it is usually necessary to frequency sweep the individual capacitors to verify the response. The microstrip 218 has a length equal to ½ the wavelength of the LO frequency, which is the frequency that the microstrip 218 is designed to filter. The microstrip 218 has a width that gives it an impedance of 50 ohms and the opposite end is short-circuited to ground, thus creating a wall and resulting in the cancellation or filtering of the LO frequency. Alternate embodiments may utilize circuit elements other than capacitors to implement this design feature, and may use it in other applications. For example, an inductor could be selected, utilizing the inductive reactance equation ($X_L$=2 πfL) as well as sweeping the component, to short-circuit the lower frequencies to ground through the microstrip element and to provide cancellation of a high frequency harmonic by the microstrip reflected signal, while at the same time leaving a different, desired high frequency component unaffected.

Figure 3:
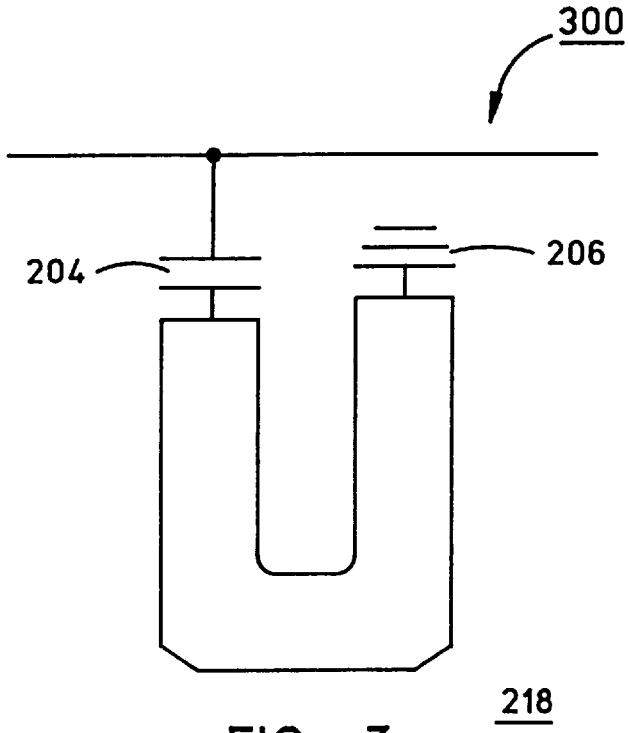
FIG. 3 is a diagram depicting the shape of a microstrip element utilizing field effects according to the present invention.

Referring to FIG. 3, the microstrip 218 is oriented, in shape and position, so as to enhance the cancellation of the LO frequency.. This is done by taking advantage of a field effect. The microstrip 218 has a "U" shape, such that the end which is short-circuited to ground is in close proximity to the end which is connected to capacitor 204. This results in a field effect which further attenuates or filters the LO frequency in the signal traveling along the circuit (see FIG. 2). The wavelengths of the signals involved give the designer a good starting point for determining where to place, and how to orient, the microstrip so as to take advantage of field effects. The designer can also utilize field equations to predict the optimal separation between the ends of a microstrip. However, spectral measurements of the canceling effect are critical to determining the impact of the field effect. In alternate embodiments, field effects (electromagnetic as well as purely electric or magnetic) can be taken advantage of with different designs to help achieve a variety of design criteria. Additionally, other types of transmission lines besides microstrip can also be employed.

Figure 4:
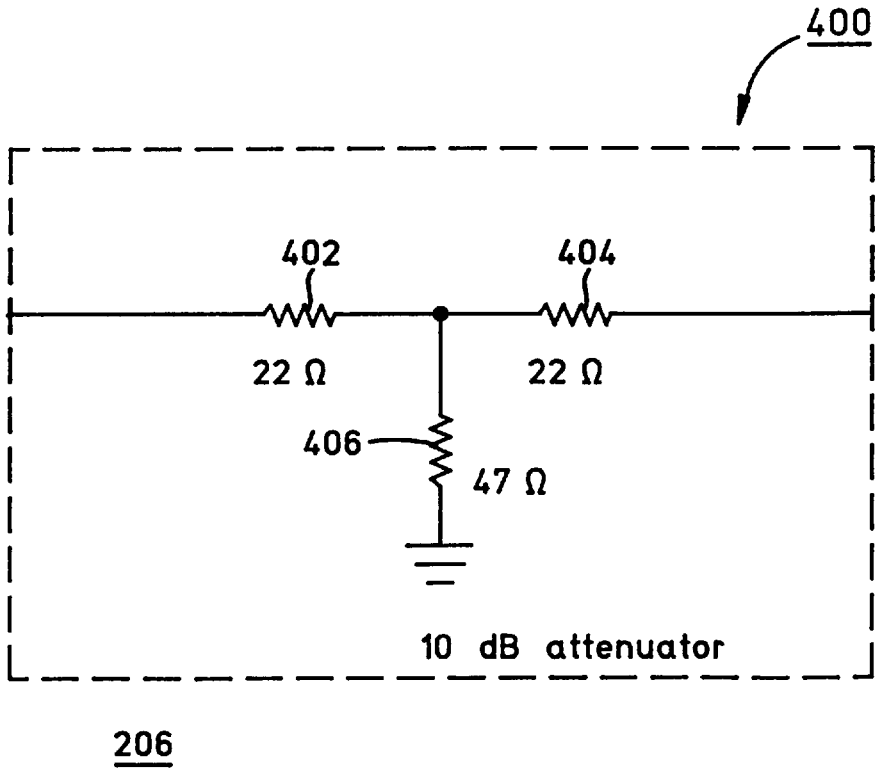
FIG. 4 is a circuit diagram of a T-type resistor attenuator for use in a frequency converter according to the present invention.

An additional feature of the circuit in FIG. 2 is the use of a T-type resistor attenuator for the 10 dB attenuator 206. An attenuator 206 is used in order to reduce the power of any reflected signals before they enter back into the signal generator 104. The attenuator 206 reduces the power of the signal by 10 dB when the signal passes through it in the forward direction, and by an additional 10 dB when the reflected signal passes through it coming back. This 20 dB attenuation of the reflected signal eliminates the disturbance effects that the reflection can have in the oscillator circuitry. The use of a T-type resistor attenuator provides further savings in the cost of components and further reduces the overall circuit size, as compared with alternative attenuators. Referring to FIG. 4, there is shown a detail 400 of the structure of the T-type resistor attenuator 206. The attenuator 206 comprises two 22 ohm resistors 402, 404 in series and one 47 ohm resistor 406 branching off from them. As is well known in the art, varying the resistor values changes the attenuation.

The task of designing filtering devices, and the circuits that contain them, in accordance with the present invention can be, at least partially, implemented by hardware, software, or a combination of both. This may be done for example, by a routine that is able to calculate parasitic effects and field effects (or has this information stored) and to optimize across a selection of circuit elements based on specific design criteria. Other aspects of the design process may also be implemented by a programmable frequency sweeper, that may be capable of being programmed to sweep devices, to record various field effects and parasitic effects, and even to incorporate these into the design optimization.

Moreover, this functionality may be embodied in computer readable media such as 3.5 inch diskettes to be used in programming an information-processing apparatus to perform in accordance with the invention. This functionality may also be embodied in computer readable media such as a transmitted waveform to be used in transmitting the information or functionality.

Although a specific embodiment of the invention has been disclosed, it will be understood by those having skill in the art that changes can be made to this specific embodiment without departing from the spirit and scope of the invention. The scope of the invention is not to be restricted, therefore, to the specific embodiment, and it is intended that the appended claims cover any and all such applications, modifications, and embodiments within the scope of the present invention.

What is claimed is:

1. A filtering device comprising a circuit element, wherein the circuit element exhibits a field effect at a selected frequency, wherein the field effect produces a desired response at the selected frequency, wherein the filtering device is designed, at least in part, to utilize the field effect to achieve the desired response at the selected frequency, wherein the desired response at the selected frequency is that of a notch filter which filters the selected frequency, wherein the circuit element comprises a transmission line having a front end and having a tail end, and wherein the transmission line's length is chosen so as to produce a partial cancellation of the selected frequency, wherein the desired response that the field effect produces is an enhancement in the cancellation of the selected frequency, and wherein the field effect is utilized by designing the filtering device such that the tail end of the transmission line is sufficiently close to the front end of the transmission line to achieve the desired cancellation.

2. The filtering device of claim 1, wherein the of the circuit element at the selected frequency comprises passing the selected frequency, and wherein the deviating response due to the field effect of the circuit element comprises filtering the selected frequency, and wherein the circuit element is selected, at least in part, so that the field effect of the circuit element can be utilized to filter the selected frequency.

3. The filtering device of claim 1, wherein the transmission line comprises a microstrip element with a length substantially equal to ½ of the selected frequency and with an impedance of approximately fifty (50) ohms.

4. The filtering device of claim 1, wherein the circuit element comprises a capacitor.

5. A method for selecting a circuit element for a filtering device comprising the steps of:

sweeping a circuit element across a pre-selected range of frequencies;

recording various field effects of the circuit element within the range of frequencies; and selecting the circuit element, for use in the circuit filtering device, that exhibits a field effect at the selected frequency, wherein the field effect results in the circuit element having a response that deviates from a pre-specified response for the circuit element at the selected frequency, and wherein the circuit element is selected for use in the filtering device, at least in part, in order to utilize the field effect at the selected frequency.

6. A method for selecting a circuit element for a filtering device comprising the steps of:

sweeping a circuit element across a pre-selected range of frequencies;

recording various parasitic effects of the circuit element within the pre-selected range of frequencies; and selecting the circuit element, for use in the filtering device, that exhibits a parasitic effect at a selected frequency, wherein the parasitic effect results in the circuit element having a response that deviates from a pre-specified response for the circuit element at the selected frequency, and wherein the circuit element is selected for use in the filtering device, at least in part, in order to utilize the parasitic effect at the selected frequency.

7. A computer readable medium containing program instructions for an information processing apparatus for designing a circuit filtering device, the program instructions comprising instructions for:

selecting a frequency range to sweep;

sweeping a circuit element across the frequency range;

recording various parasitic effects of the circuit element within the frequency range of determining a desired response of the filtering device at the selected frequency within the range; and selecting the circuit element, for use in the circuit filtering device, that exhibits a parasitic effect at the selected frequency, wherein the parasitic effect results in the circuit element having a response that deviates from a pre-specified response for the circuit element at the selected frequency, and wherein the circuit element is selected for use in the filtering device, at least in part, in order to utilize the parasitic effect at the selected frequency.

8. A computer readable medium containing program instructions for an information processing apparatus for designing a circuit filtering device, the program instructions comprising instructions for:

selecting a frequency range to sweep;

sweeping a circuit element across the frequency range;

recording various field effects of the circuit element within the frequency range of determining a desired response of the filtering device at the selected frequency within the range; and selecting the circuit element, for use in the circuit filtering device, that exhibits a field effect at the selected frequency, wherein the field effect results in the circuit element having a response that deviates from a pre-specified response for the circuit element at the selected frequency, and wherein the circuit element is selected for use in the filtering device, at least in part, in order to utilize the field effect at the selected frequency.

9. A frequency converter comprising a first notch filter which filters a first frequency and does not filter a second frequency, wherein the first notch filter comprises:

a lumped parameter element having a first terminal and a second terminal, and having a frequency characteristic such that a first frequency is not filtered by the lumped parameter element and a second frequency is filtered by the lumped parameter element and therefore does not pass through it; and a transmission line comprising a first end and a second end, wherein the first end is coupled to the second terminal, and wherein the transmission line has a length chosen to produce a partial cancellation of the selected frequency, and wherein the desired response that the field effect produces is an enhancement in cancellation of the second frequency, and wherein the field effect is utilized by designing the notch filter such that the tail end of the transmission line is sufficiently close to the front end of the transmission line to achieve the desired cancellation.

10. The frequency converter of claim 9, wherein:

the lumped parameter element comprises a capacitor; and the transmission line comprises a microstrip element and has an impedance of approximately fifty (50) ohms, and the second end is coupled to ground.

* * * * *